US005183417A

United States Patent [19]

Bools

[11] Patent Number: 5,183,417

[45] Date of Patent: Feb. 2, 1993

[54] CABLE BACKSHELL

[75] Inventor: William G. Bools, Montgomery, Ohio

[73] Assignee: General Electric Company, Cincinnati, Ohio

[21] Appl. No.: 805,135

[22] Filed: Dec. 11, 1991

[51] Int. Cl.[5] ..... H01R 9/03

[52] U.S. Cl. ..... 439/610; 439/583; 439/905

[58] Field of Search ..... 439/610, 609, 607, 108, 439/274, 279, 98, 92, 99, 101, 578, 583, 904, 905; 174/35 C, 35 R, 78

[56] References Cited

U.S. PATENT DOCUMENTS

| | | | |
|---|---|---|---|
| 3,659,251 | 4/1972 | Fish | 339/143 R |
| 3,944,317 | 3/1976 | Oberdiear | 439/610 |
| 4,243,290 | 1/1981 | Williams | 339/143 R |
| 4,382,653 | 5/1983 | Blanchard | 339/143 R |
| 4,422,710 | 12/1983 | Perona | 339/177 R |
| 4,531,805 | 1/1985 | Werth | 339/143 R |
| 4,583,809 | 4/1986 | Werth et al. | 339/143 R |
| 4,804,338 | 2/1989 | Dibble et al. | 439/583 |
| 4,808,128 | 2/1989 | Werth | 439/610 |
| 4,830,628 | 5/1989 | Dyson et al. | 439/584 |
| 4,854,891 | 8/1989 | Kami et al. | 439/610 |
| 4,857,015 | 8/1989 | Michaels et al. | 439/610 |
| 4,921,441 | 5/1990 | Sauder | 439/460 |
| 4,921,449 | 5/1990 | Fish | 439/610 |

FOREIGN PATENT DOCUMENTS 62225970 3/1989 Japan .

OTHER PUBLICATIONS

CFM Component Maintenance Manual (Jan. 1, 1988) for Electrical Harness J12 (Part No. 320-198-501-0) pp. 605, 612, 621, 625, 627, 628, 630, 646, 1002 and 1003.

*Primary Examiner*—Larry I. Schwartz
*Assistant Examiner*—J. R. Daulton
*Attorney, Agent, or Firm*—Bernard E. Shay; Jerome C. Squillaro

[57] ABSTRACT

The present invention is directed to an electrical cable assembly comprising a cable termination piece adapted to engage a backshell nut. The cable outer shield is terminated at the termination piece. The backshell assembly comprises an outer backshell cable shield connected between two backshell nuts such that the backshell may be disengaged from the connector and, or the cable termination piece to access the signal wires in the cable.

2 Claims, 2 Drawing Sheets

CABLE BACKSHELL

The U.S. Government has rights in this invention pursuant to contract no. F33657-83-C-0281 awarded by the United States Air Force.

The following commonly assigned applications are directed to related subject matter and are being concurrently filed with the present application, the disclosures of which are hereby incorporated herein by reference:

U.S. Patent application Ser. No. 07/805,136, filed on Dec. 11, 1991.

U.S. Patent application Ser. No. 07/805,134, filed on Dec. 11, 1991.

The present invention relates, in general, to connectors for electrical cables and, more particularly, to an improved backshell structure for electrical cable connectors.

BACKGROUND OF THE INVENTION

Electric cables for modern aircraft engines normally include a number of individually shielded wires surrounded by a conduit which is itself surrounded by a shield. Since most discontinuities in such cables occur at the cable connectors, it would be advantageous to design a cable termination wherein the individual wires would be easily accessible and repairable. It would further be advantageous if the cable termination or connector were designed such that repairs to individual wires did not destroy the EMI shielding or the environmental seal of the connector. Finally, it would be advantageous to eliminate the potting material normally used to protect individual wires between the cable end and the connector.

SUMMARY OF THE INVENTION

The present invention is directed to an electrical cable assembly comprising an improved backshell. The backshell assembly comprises an outer backshell cable shield connected between two backshell nuts such that the backshell may be disengaged from the connector and/or the cable termination piece to access the signal wires in the cable. The improved backshell further includes a cable termination piece adapted to mate with a first of the backshell nuts providing electrical continuity between the outer cable shield and the outer backshell shield. In addition, an inner shield termination is provided to provide electrical continuity for the inner cable shield at the junction between the connector and the second backshell nut.

BRIEF DESCRIPTION OF THE DRAWINGS

The novel features of the invention are set forth with particularity in the appended claims. The invention itself, however, both as to organization and method of operation, together with further objects and advantages thereof, may best be understood by reference to the following description taken in conjunction with the accompanying drawings in which:

DETAILED DESCRIPTION OF THE INVENTION

Figure 1:
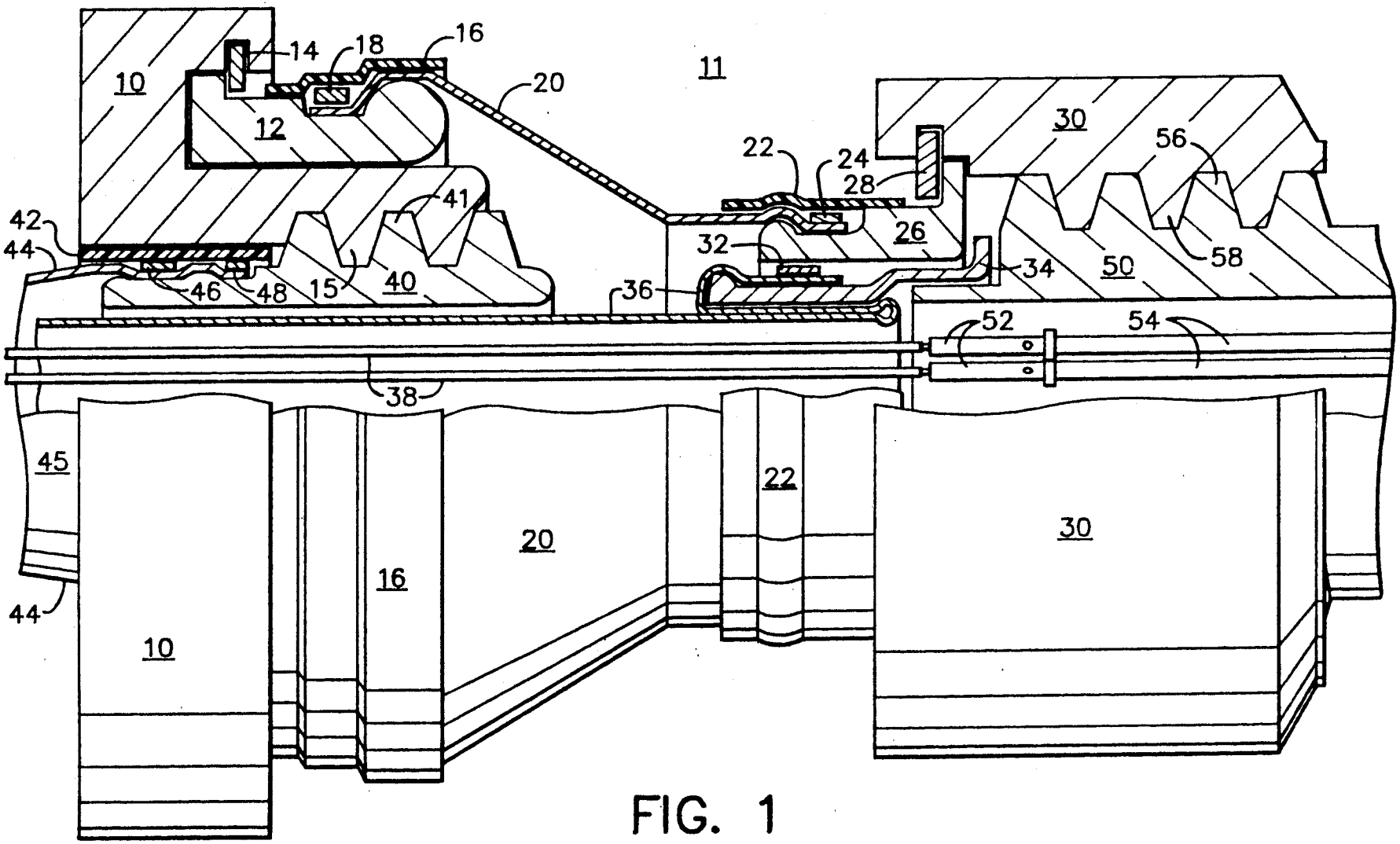
FIG. 1 is a cutaway view of a backshell connector according to the present invention.

FIG. 1 is a cut away view of a backshell connector 11 according to one embodiment of the present invention. In FIG. 1, backshell coupling nut 10 includes threads 15 which engage threads 41 of cable termination 40. Backshell nut 10 is rotatably connected to backshell termination 12 by washer 14. As used herein, the term washer (e.g. washer 14) may include, for example, snap rings, split washers, true arcs or helical washers The function of these washers is to rotatably engage the backshell nuts to the backshell terminations such that the nuts may be tightened or loosened without turning the backshell shield 20. Band clamp 18 holds outer backshell shield 20 in position around backshell termination 12. Backshell shield 20 may be, for example, an electrically conductive mesh or solid material Shrink tubing 16 surrounds band clamp 18 and a portion of shield 20 and a portion of termination 12.

Cable termination 40 includes teeth 41 adapted to engage teeth 15 of backshell nut 10. Band clamps 46 and 48 hold outer cable shield 44 to cable termination 40. Outer cable shield 40 may be, for example, an electrically conductive outer layer of cable 45. Shrink tubing 42 surrounds band clamp 46, band clamp 48, a portion of cable termination 40 and a portion of outer cable shield 44.

Inner cable shield 36, which may be, for example, the ordinance braids of wires 38, is clamped to inner shield termination 34 by band clamp 32. Inner shield termination 34 is adapted to fit over a portion of connector body 50. Inner shield termination 34 is adapted to be held in place by backshell termination 26.

Outer backshell shield 20 is attached to backshell termination 26 by band clamp 24. Backshell termination 26 is rotatably attached to backshell nut 30 by washer 28. Shrink tubing 22 surrounds band clamp 24, a portion of backshell termination 26 and a portion of outer backshell shield 20.

Backshell nut 30 includes teeth 58 adapted to engage teeth 56 of connector body 50. In FIG. 1, a portion of connector body 50 is not shown since the present invention is directed to the improved backshell.

Wires 38 terminate at connector body 50 in "pokehome" pins 52. Poke-home sockets 52 may be connected to pokehome pin connectors 54 which, in turn, are connected to other connectors when connector body 50 is attached to a Line Replaceable Unit (LRU) or other electronic device.

Improved backshell 11 of FIG. 1 is adapted to provide substantial Electro-Magnetic Radiation (EMI) shielding for wires 38 in cable 45. In addition, backshell 11 enhances access to wires 38 and connector body 52 for repairing wires 38 or sockets 52 or any other electrical problems at the connector.

In order to provide EMI shielding, there must be electrical continuity from outer cable shield 44 to connector body 50. In addition, it would be advantageous to seal wires 38 from environmental hazards such as water or fuel. Finally, it would be advantageous to provide a second shield which improves the EMI shielding beyond that provided by outer backshell shield 20.

In the embodiment of FIG. 1, band clamps 46 and 48 bind outer cable shield 44 to electrically conductive cable termination 40 which may be manufactured from, for example nickel, shrink tubing 42 provides an environmental barrier at the interface between shield 44 and termination 40. Conductive backshell nut 10 is screwed onto cable termination 40 and threads 15 and 41 provide an electrical path between nut 10 and termination 40. An environmental barrier shielding might be provided by, for example, covering backshell 11 with shrink fit tubing or by other suitable means.

Electrical continuity is provided between nut 10 and outer backshell shield 40 by electrically conductive backshell termination 12. Backshell termination 12 is rotatably connected to nut 10 by electrically conductive washer 14 which allows nut 10 to rotate without rotating termination 12. Termination 12 is connected to electrically conductive backshell shield 20 by band clamp 18 which is covered by shrink tubing 16.

Electrical continuity between shield 20 and backshell nut 30 is provided by electrically conductive backshell termination 26 which is attached to shield 20 by band clamp 24 and covered by shrink tubing 22. Electrically conductive washer 28 rotatably connects termination 26 to nut 30.

Additional EMI shielding and/or an environmental barrier may be provided by inner cable shield 36. Inner cable shield 36 is connected to electrically conductive inner shield termination 34 by band clamp 32. Termination 34 slides over a portion of connector body 50 and is positioned between connector body 50 and backshell termination 26 such that, when backshell nut 30 is tightened, termination 34 is forced against connector 50.

Figure 2:
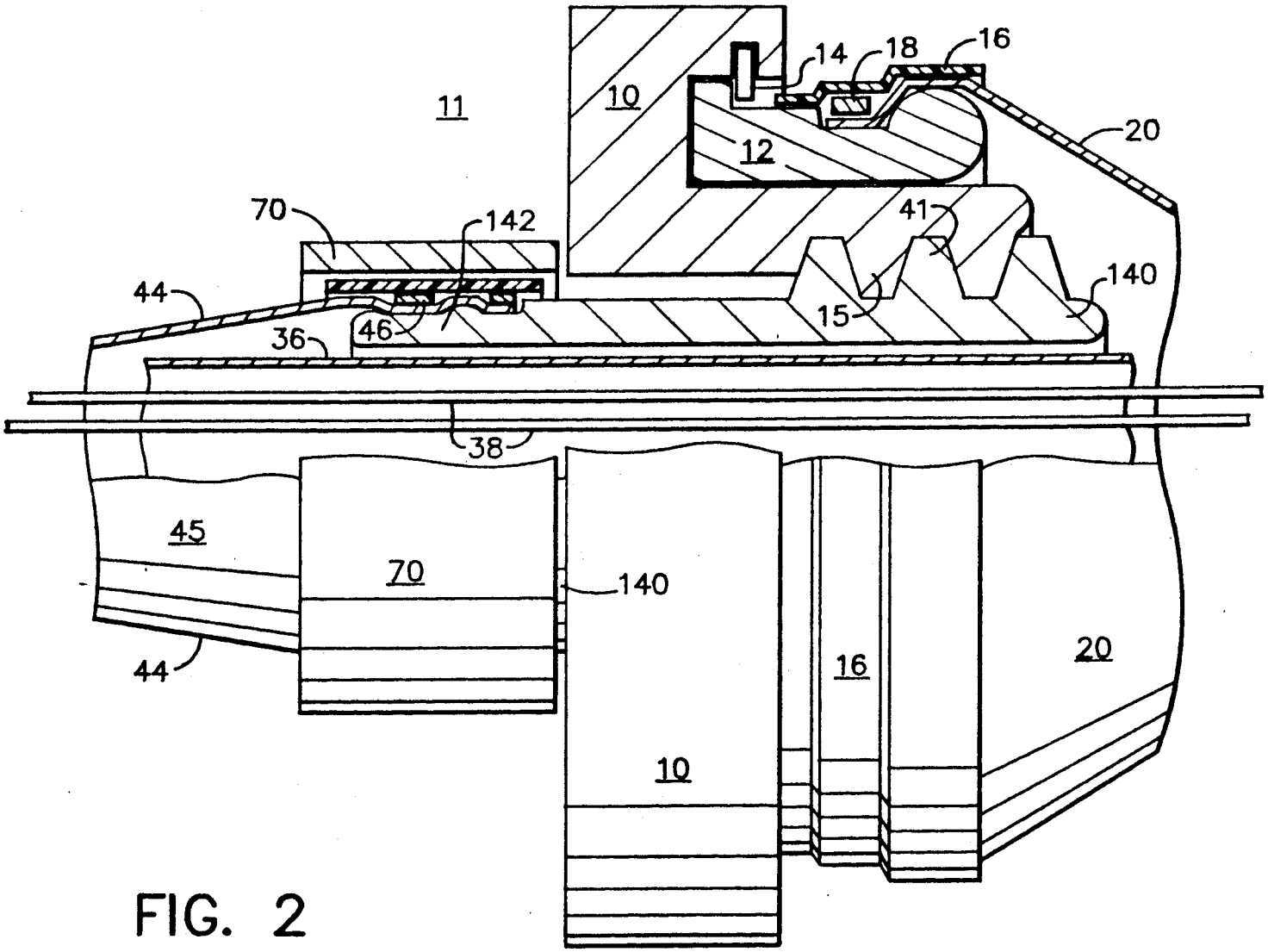
FIG. 2 is a cutaway view of a portion of a backshell connector according to an embodiment of the present invention.

In FIG. 2, cable termination 140 includes a portion 142 which extends beyond backshell nut 10. By extending termination 140, it may be attached to, for example, a gas turbine engine by a clamp 170. Clamp 170 may be, for example, a band clamp, saddle and band clamp or other suitable device. Clamp 170 is also advantageous in that it prevents nut 10 from backing off termination 140 due to, for example, vibration.

While preferred embodiments of the present invention have been shown and described herein, it will be obvious to those skilled in the art that such embodiments are provided by way of example only. Numerous variations, changes, and substitutions will now occur to those skilled in the art without departing from the invention. Accordingly, it is intended that the invention be limited only by the spirit and scope of the appended claims.

What I claim is:

1. An electrical cable assembly comprising:

a first cable termination piece including a threaded portion;

a first backshell nut including a threaded portion adapted to mate with said threaded portion of said first cable termination piece;

a second backshell nut including a threaded portion adapted to mate with a threaded portion of a connector; and a backshell cable shield;

a first backshell cable termination attached to said first backshell nut and freely rotatable with respect thereto, a first end of said backshell cable shield being affixed to said cable termination; and a second backshell cable termination attached to said second backshell nut and freely rotatable with respect thereto, a second end of said backshell cable shield being affixed to said cable termination.

2. A cable assembly according to claim 1 further comprising:

an inner shield termination piece adapted to fit between said second backshell cable termination and said connector such that said inner shield termination piece is held against said connector by said first backshell cable termination; and an inner backshell shield connected to said inner shield termination piece.

* * * * *